US005842653A

United States Patent [19]

Elliott et al.

[11] Patent Number: 5,842,653

[45] Date of Patent: Dec. 1, 1998

[54] SLOW SPEED HAMMERMILL FOR SIZE REDUCTION OF WOOD CHIPS

[75] Inventors: James C. Elliott; John R. Blake, both of Spartanburg, S.C.

[73] Assignee: Global Processing Systems, Inc., Woodruff, S.C.

[21] Appl. No.: 791,101

[22] Filed: Jan. 24, 1997

[51] Int. Cl.[6] ..... B02C 13/284

[52] U.S. Cl. ..... 241/88.1; 241/89.3; 241/194

[58] Field of Search ..... 241/189.1, 73, 241/194, 195, 88.1, 88.4, 88.3, 88.2, 89.3

[56] References Cited

U.S. PATENT DOCUMENTS

| | | | |
|---|---|---|---|
| Re. 14,926 | 7/1920 | Plaisted . | |
| Re. 28,368 | 3/1975 | Bonnarrigo . | |
| 1,420,355 | 6/1922 | Williams | 241/88.1 |
| 1,439,754 | 12/1922 | Plasisted | 241/88.1 |
| 1,469,510 | 10/1923 | Hochenauer . | |
| 1,889,129 | 11/1932 | Nielsen . | |
| 2,015,581 | 9/1935 | Armour . | |
| 2,141,664 | 12/1938 | Ossing | 241/88.4 |
| 2,225,095 | 12/1940 | Beverly | 241/88.1 |
| 2,463,223 | 3/1949 | Verch . | |
| 2,573,227 | 10/1951 | Sheely . | |
| 3,074,655 | 1/1963 | Gontier . | |
| 3,682,401 | 8/1972 | Jacobson et al. . | |
| 3,722,805 | 3/1973 | Strom . | |
| 3,738,586 | 6/1973 | Fabert, Jr. . | |
| 3,752,410 | 8/1973 | Dienst et al. . | |
| 3,891,152 | 6/1975 | Guggenheimer . | |
| 3,946,954 | 3/1976 | Sousek . | |
| 4,009,836 | 3/1977 | Strom et al. . | |
| 4,015,783 | 4/1977 | Miller . | |
| 4,061,277 | 12/1977 | Whitney . | |
| 4,102,504 | 7/1978 | Mushrush et al. . | |
| 4,129,262 | 12/1978 | Lowry . | |
| 4,141,512 | 2/1979 | Francis . | |
| 4,146,184 | 3/1979 | Whitney . | |
| 4,146,185 | 3/1979 | Schober . | |
| 4,226,375 | 10/1980 | Cameron . | |
| 4,310,125 | 1/1982 | Novotny . | |
| 4,558,826 | 12/1985 | Martinek . | |
| 4,875,630 | 10/1989 | Carlson . | |
| 4,958,775 | 9/1990 | Arasmith | 241/88.1 |
| 5,002,233 | 3/1991 | Williams . | |
| 5,018,674 | 5/1991 | Williams . | |
| 5,078,328 | 1/1992 | Willingham . | |
| 5,188,500 | 2/1993 | Eide et al. . | |
| 5,381,975 | 1/1995 | Chon et al. . | |

OTHER PUBLICATIONS

Jeffrey® Wood and Bark Hogs and Shredders, Catalogue 24591, Jeffrey/Dresser,1991 (p. 1–p. 8).

Flextooth® Crushers, Catalogue 24994, Jeffrey/Indresco, 1994 ( 7 pages).

Jeffrey® Tyype AB Hammermills, Catolog 25294, Jeffrey/Indresco, 1994 (p. 1–p. 8).

*Primary Examiner*—Mark Rosenbaum

*Attorney, Agent, or Firm*—Baker & Botts, L.L.P.

[57] ABSTRACT

A hammermill having a rotor assembly and a screen bar assembly is provided to reduce oversized wood chips. The hammermill may also be used to reduce wood and/or bark, the rotor assembly includes flexible hammers which are pivotally attached to allow each flexible hammer to move radially inward or radially outward during rotation of the rotor assembly. Each flexible hammer preferably includes a recess with a portion of a support rod disposed therein to limit radial movement inward and outward relative to the rotor assembly. The screen bar assembly includes a plurality of screen bars having a beveled surface formed along one edge of each screen bar disposed adjacent to the rotor assembly. The flexible hammers allow the rotor assembly to rotate at lower revolutions per minute which reduces the amount of fines and undersized wood chips produced by the associated hammermill. Cooperation between the flexible hammers and the configuration of the screen bar assembly along with the beveled surfaces further reduces the amount of fines and undersized wood chips produced by the associated hammermill.

13 Claims, 3 Drawing Sheets

SLOW SPEED HAMMERMILL FOR SIZE REDUCTION OF WOOD CHIPS

TECHNICAL FIELD OF THE INVENTION

The present invention relates primarily to hammermills for reducing or shredding wood and bark and more specifically to a slow speed hammermill used to size wood chips for paper manufacturing.

BACKGROUND OF THE INVENTION

Hammermills are used in applications to reduce a wide range of materials including junked automobiles, friable materials such as limestone and coal and fibrous materials such as wood. Reducing or shredding these different types of material has resulted in a wide variety of designs and construction techniques to optimize the respective hammermill's performance in reducing or shredding the selected material. Automobile hammermills typically comprise apparatus that rotates relative to a cutter bar at the end of a feeder chute through which a junked automobile is fed. The rotating apparatus conventionally comprises four or six rows of hammers with each row including a plurality of hammers mounted for swinging movement on a common shaft or rotor which typically rotates at 700–900 revolutions per minute (RPM). For each revolution, each of the four or six rows of hammers passes by the cutter bar, shearing or shredding a junked automobile as it is fed along the entry chute. Due to the large size of an automobile hammermill, the tip speed of each hammer is very high.

Hammermills associated with reducing and/or shredding wood and bark are sometimes referred to as "wood or bark hogs." Hammer tip speeds are typically 11,000–15,000 feet per minute (FPM) for such wood and bark hogs. Many hammermill applications with swinging hammers have a tip speed of 11,000–12,000 FPM. This relatively high tip speed is required to have enough impact energy to properly reduce the material and to have enough force to hold the associated swinging hammers radially outward. Slow speed hammermills typically include a plurality of hammers which are rigidly mounted on a rotating shaft or rotor.

Some applications such as paper manufacturing require a large quantity of generally uniform sized wood chips. Oversized chips are typically screened out and resized or rechipped to the desired dimensions. Knife type rechippers with either disk or drum style rotors are often used to reduce oversized wood chips. Such knife type rechippers have a tendency to become plugged and frequently require substantial amounts of time and money for repair and maintenance. Hammermills that have previously been used to resize wood chips typically operate at tip speeds of around 10,000 FPM. The higher speeds produce a higher percentage of fines and/or undersized wood chips. Knife type rechippers also typically produce a substantial quantity of fines and oversized wood chips. The cost of resharpening and/or replacing knives associated with such rechippers can be as much as $20–30,000 per year. Knife type rechippers are also susceptible to damage from any metal trapped or contained in the oversized wood chips.

During the cooking process associated with manufacturing paper, fines and undersized chips typically produce a mush type mixture which does not contain cellulose fibers of the required length for high quality paper production. Both oversized and undersized chips are often not completely digested during the cooking process and result in waste material.

SUMMARY OF THE INVENTION

In accordance with teachings of the present invention, an improved, slow speed hammermill is provided to substantially reduce or eliminate shortcomings previously associated with hammermills and other types of equipment used to reduce wood, bark and oversized wood chips. For one application the present invention provides a wood chip resizer that substantially reduces the quantity of fines produced during resizing of oversized wood chips. For other applications, the present invention provides a slow speed hammermill for reducing wood and bark to provide wood chips having a selected size.

In accordance with one aspect of the present invention, a hammermill is provided with a plurality of flexible hammers. Each flexible hammer preferably includes a moment arm with one end rotatably mounted on a supporting rod and a crushing element formed on the other end. For some applications the crushing element may include a reversible hook or a replaceable hook. The flexible hammers allow the associated hammermill to operate at relatively low speeds which minimizes fines produced from reducing oversized wood chips while at the same time providing sufficient force to keep the hammers properly extended. Each hammer may flex inwardly from the crushing circle or reducing zone to protect the hammermill from damage by tramp metal and any other uncrushable materials contained in the oversized wood chips. The use of flexible hammers having a moment arm combines the compression crushing concept associated with roller crushers and the high capacity of impact crushers in the resulting slow speed hammermill. Reducing the revolutions per minute and particularly reducing the tip speed of each flexible hammer substantially reduces the percentage of fines and undersized chips produced by the associated hammermill.

Another aspect of the present invention includes combining a slow speed hammermill with a screen bar assembly or grate assembly having a plurality of screen bars with a beveled edge formed on each screen bar. The beveled edges are preferably angled into the direction of rotation of the associated hammers. This allows easier egress of the resized chips from the screen bar, which further reduces fines. The screen bar assembly preferably has a generally semicircular configuration extending over approximately 180° of rotation of the associated hammers. For one application, the radial spacing between adjacent screen bars of the screen bar assembly is approximately two (2) inches. For other applications, the present invention allows increasing or decreasing the radial spacing between adjacent bars of the screen bar assembly to satisfy changes in requirements for each application. As a result of increasing or decreasing the radial spacing, the resulting screen bar assembly further reduces the quantity of fines produced by the associated hammermill while the quantity of oversized chips is maintained within acceptable limits.

Technical advantages of the present invention include reducing oversized wood chips to a selected size and/or configuration that will optimize digestion of the resulting wood chips during the manufacture of high quality paper from wood pulp. The amount of fines produced by the associated hammermill is substantially minimized. Cooperation between flexible hammers and a screen bar assembly incorporating teachings of the present invention provides better control of both the quantity and size of any oversized chips produced by the associated hammermill, and produces more fractured chips which allow better penetration of the liquor or solvent used to digest the wood chips. The overall recovery rate of cellulose fibers having the desired length for high quality paper manufacturing is significantly increased. For some applications, the present invention results in recovery rates in the range of approximately eighty percent (80%) to ninety-two percent (92%) for oversized wood chips.

BRIEF DESCRIPTION OF THE DRAWINGS

For a more complete understanding of the present invention and for further advantages thereof, reference is now made to the following written description taken in conjunction with the accompanying drawings, in which.

DETAILED DESCRIPTION OF THE INVENTION

The preferred embodiments of the present invention and its advantages are best understood by referring to FIGS. 1 through 6 of the drawings, like numerals being used for like and corresponding parts of the various drawings.

Figure 1:
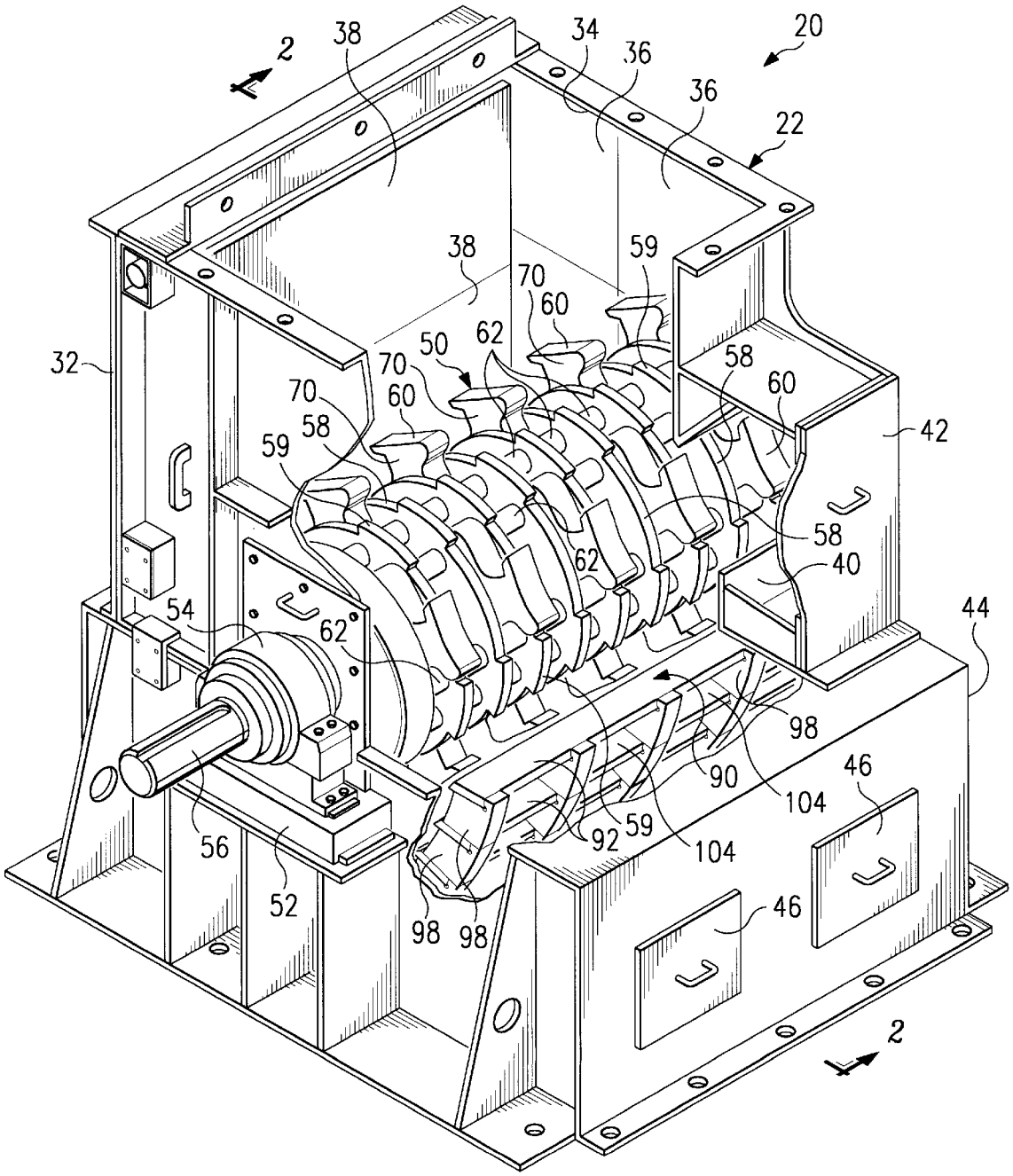
FIG. 1 is a schematic drawing showing an isometric view with portions broken away of a slow speed hammermill for reducing wood, bark and/or oversized wood chips in accordance with teachings of the present invention.
Figure 2:
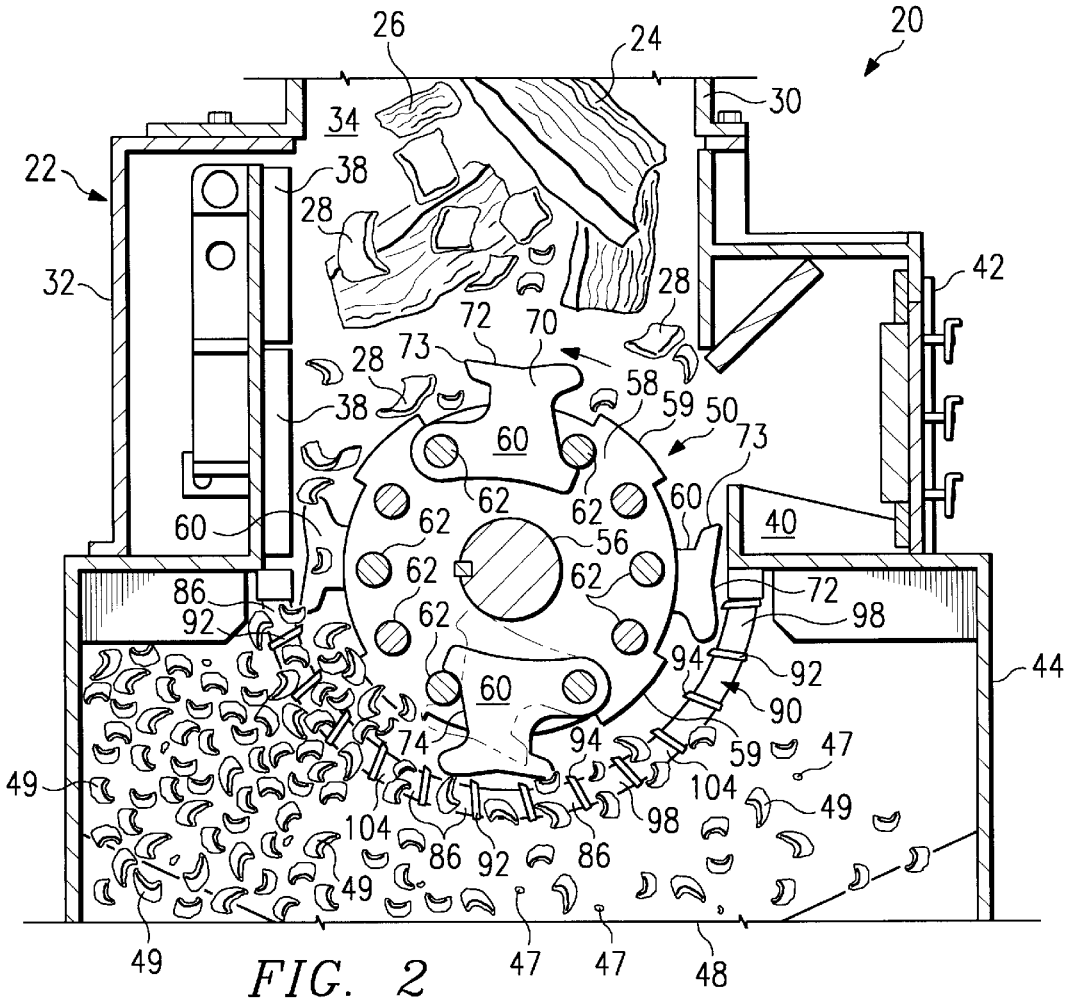
FIG. 2 is a schematic drawing in section taken along lines 2—2 of FIG. 1 showing flexible hammers and a screen bar assembly or grate assembly incorporating teachings of the present invention.

Hammermill 20 incorporating teachings of the present invention is shown in FIGS. 1 and 2. The components of hammermill 20 include housing 22, rotor assembly 50 and screen bar assembly or grate assembly 90. As shown in FIG. 2, wood 24, bark 26 and/or oversized wood chips 28 may be fed into housing assembly 22 through chute 30 and reduced. As a result of the present invention, hammermill 20 is particularly efficient at reducing oversized wood chips 28 to provide a high percentage of resized wood chips 49. Hammermill 20 may sometimes be referred to as a wood chip sizer. However, a hammermill incorporating teachings of the present invention may be used to reduce a wide variety of materials including wood 24 and bark 26 and is not limited to reducing oversized wood chips 28.

Cooperation between rotor assembly 50 and its associated flexible hammers 60 along with screen bar assembly 90 substantially reduces the amount of fines and small undersized chips or pin chips 47 produced by hammermill 20, while at the same time controlling the quantity of any oversized chips produced by hammermill 50. The present invention allows optimizing the size and quantity of wood chips 49 produced from hammermill 20 to minimize waste and to maximize the amount of cellulose fibers having the desired length for the manufacture of high quality paper.

Wood is generally prepared for paper manufacturing by two different processes. For one application, wood blocks are held against a rapidly revolving grindstone that shreds short wood fibers from the block. The resulting short fibers produced by this grinding process are typically used only in the production of relatively low quality paper such as newsprint or as an add mixture with other types of wood fiber to make high quality paper.

For the other application, wood chips having generally larger, more uniform dimensions are formed as one of the first steps in the process of manufacturing high quality paper. The resulting wood chips may be treated by various chemical solvents (sometimes referred to as "liquors") to remove resinous materials and lignin from the wood chips to provide pure cellulose fibers having the desired length to produce high quality paper. The wood chips and chemical solvent are typically cooked or digested under steam pressure. One of the oldest chemical processes involves the use of caustic soda as a solvent. Sodium sulphate and magnesium sulphate are frequently used solvents in modern wood chip digesting and paper manufacturing processes. Wood chips which are oversized are frequently screened out and "rechipped" to the desired dimensions. Fines and undersized chips are often discarded as waste prior to cooking. As a result of incorporating various teachings of the present invention, hammermill 20 can optimize the production of wood chips by reducing the quantity of fines and undersized chips while at the same time controlling the quantity of oversized chips to within acceptable limits.

Housing 22 is preferably formed from thick, heavy steel plates. Upper housing assembly 32 includes inlet or feed opening 34 on which chute 30 may be mounted. The interior portions of upper housing assembly 32 are preferably covered with a plurality of thick, replaceable liner plates 36 which protect upper housing assembly 32 from wear and heavy impact. For one application, liner plates 36 are formed from steel alloys which have been heat treated to increase their hardness and to maximize the life of hammermill 20. Liner plates 36 may be bolted or otherwise releasably secured to the interior of upper housing assembly 32 until replacement is required. Heavy duty breaker plates 38 may be disposed within upper housing assembly 32 extending downwardly from inlet 34.

As best shown in FIG. 2, rotor assembly 50 and its associated rows of flexible hammers 60 rotate toward breaker plates 38 such that flexible hammers 60 will cause large pieces of wood 24 and bark 26 to be forced against breaker plates 38. When hammermill 20 is used to resize oversized wood chips, wood 24 and bark 26 may have typical dimensions of approximately seven or eight inches in length, three or four inches in width and one half inch thick. Hammermill 20 may be modified in accordance with teachings of the present invention to reduce wood and bark having other dimensions as desired. Portions of housing 22 are similar to hammermills or wood hogs manufactured and sold by Jeffrey, Global Processing Systems located in Woodruff, South Carolina.

Upper housing assembly 32 preferably includes one or more metal traps 40 disposed adjacent to and extending substantially parallel with rotor assembly 50 opposite from breaker plates 38. As a result of the direction of rotation of rotor assembly 50, large oversized chips 28 or pieces of wood 24 and bark 26 will be broken up by striking breaker plates 38. At the same time, pieces of tramp metal will tend to accumulate within metal traps 40. One or more clean out covers 42 are provided to allow removal of tramp metal and other uncrushable material from metal traps 40.

Upper housing assembly 32 is attached to and supported by lower housing assembly 44. Lower housing assembly 44 is preferably formed from heavy steel plates similar to upper housing assembly 32. Lower housing assembly 44 includes one or more clean out and inspection covers 46 and outlet 48 to allow resized wood chips 49 to exit from hammermill 20. Lower housing assembly 44 provides support for bearing blocks 52 which in turn support respective roller bearing assemblies 54 at opposite ends of rotor assembly 50. The various components associated with rotor assembly 50 are attached to shaft 56 which extends longitudinally through housing 22 and is supported by roller bearing assemblies 54. A motor or other suitable power source (not expressly shown) may be attached to shaft 56 to rotate rotor assembly 50.

Rotor assembly 50 includes a plurality of disk-type rotors 58 concentrically disposed on the exterior of shaft 56. A plurality of lugs 59 are preferably formed as an integral part of the outside diameter of each rotor 58. Depending upon the volume of wood, bark and/or oversized wood chips fed into chute 30, lugs 59 may cooperate with flexible hammer 60 to reduce or shred the wood, bark or oversized wood chips. Lugs 59 are particularly effective when a large surge of wood, bark or oversized wood chips enters the upper housing assembly 32 causing flexible hammers 60 to retract radially inward toward shaft 56.

A plurality of support rods 62 extend longitudinally through rotor disks 58 parallel with shaft 56. Rods 62 are spaced radially from each other adjacent to the outside diameter of rotor disks 58. A plurality of flexible hammers 60 or 160 may be pivotally disposed between adjacent rotor disks 58. For the embodiment shown in FIGS. 1 and 2, a pair of flexible hammers 60 is disposed diametrically opposite from each other between rotor disks 58. The number of flexible hammers 60 may be varied depending upon the dimension of the associated hammermill 20 and the type of wood and bark fed into chute 30. Flexible hammers have previously been manufactured and sold by Jeffrey, Global Processing Systems located in Woodruff, S.C. for use in hammermills that crush friable materials such as coal and limestone.

Each flexible hammer 60 preferably includes hammer body 64 having moment arm 66 extending generally from opening 68 to recess 74. The dimensions of opening 68 and the outside diameter of support rods 62 are selected to allow one of the support rods 62 to be inserted through opening 68 to rotatably secure the associated flexible hammer 60 between adjacent disk rotors 58. Hammer body 64 may be formed from various hard metal alloys and is preferably heat treated for long term wear.

Hammer body 64 also includes an enlarged portion or crushing element 70 preferably formed as an integral part of moment arm 66 opposite from opening 68. Hooked head 72 having at least one tearing edge 73 is preferably formed as an integral part of crushing element 70. The configuration and dimensions of hooked head 72 are selected to be compatible with reducing wood, bark and/or oversized wood chips. For some applications hooked head 72 and/or crushing element 70 may be formed as separate, replaceable components.

Recess 74 is formed in the edge of crushing element 70 opposite from opening 68 and is sized to receive a portion of an adjacent support rod 62. The dimensions of flexible hammer 60 and recess 74 along with the radial spacing between adjacent support rods 62 are selected to allow each flexible hammer 60 to move radially inward and outward. See dotted lines in FIG. 2. Shoulders 76 and 78 are formed as part of recess 74 to limit the amount of radial movement of the respective flexible hammer 60.

As best shown in FIG. 2, rotation of shaft 56 will cause flexible hammers 60 to move radially outward until shoulder 76 of each flexible hammer 60 contacts its associated support rod 62 partially disposed within recess 74. Recess 74 allows the associated flexible hammer 60 to move radially inward until the respective shoulder 78 contacts the associated support rod 62 limiting the amount of radially inward movement. Moment arm 66 serves as a fulcrum to help maintain crushing element 70 and hooked head 72 radially extended from disk rotors 58 even when shaft 56 is rotating at relatively low RPMs.

Traditionally, fixed hammers have been used with low speed hammermills because swing type hammers will generally not remain satisfactorily extended at low RPMs. U.S. Pat. Nos. 3,074,655 and 3,738,586 show examples of swing hammers.

The term "flexible" is used to indicate that moment arm 66 in cooperation with opening 68 and recess 74 allows limited radial movement of each flexible hammer 60 inward and outward as best shown in FIG. 2 in response to increased amounts of wood, bark and/or oversized chips fed into chute 30. Since flexible hammers 60 can move radially inward, they apply a more uniform, constant amount of force to a large quantity of oversized chips 28 entering through chute 30.

Flexible hammers 60 also provide a more uniform force as oversized chips 28 are dragged or compressed against screen bar assembly 90. For the embodiment of the present invention as shown in FIG. 2, the limited radial movement of flexible hammers 60 will relieve some of the force or pressure as oversized wood chips 28 are placed in shear between crushing element 70 and screen bar assembly 90. The resulting, "softer" shear action associated with reducing oversized chips 28 helps to reduce the production of fines and/or pin chips 47.

Some hammermills with rigid or fixed hammers may be capable of operating at slower speeds but the associated rigid hammers do not provide any relief when oversized wood chips are placed in shear and, therefore, typically produce a much greater quantity of fines and pin sized chips 47 as compared to a slow speed hammermill incorporating teachings of the present invention. Thus, the interaction between flexible hammers 60 and breaker plates 38 and flexible hammers 60 and screen bar assembly 90 produces substantially less fines and undersized wood chips 47 with a larger quantity of wood chips 49 having the desired uniform size and configuration.

Screen bar assembly or grate assembly 90 is attached to the opening between upper housing assembly 32 and lower housing assembly 44 and extends substantially parallel with rotor assembly 50. For the embodiment shown in FIG. 2, screen bar assembly 90 has a generally semicircular configuration extending over approximately one hundred and eighty degrees (180°) of the rotation of rotor assembly 50. Screen bar assembly 90 includes a plurality of screen bars 92 having a generally rectangular cross-section. The length of screen bars 92 is selected to be substantially equal to the length of rotor assembly 50 disposed within housing 22. For some applications slots or grooves (not expressly shown) may be formed within opposite sides of lower housing 44 to receive respective ends of each screen bar 92. Various techniques which are well known in the art may be used to mount screen bar assembly 90 within lower housing assembly 44 adjacent to rotor assembly 50. Also, multiple screen bars having an individual length less than the length of rotor assembly 50 may be used for some applications.

The longitudinal edge of each screen bar 92 disposed adjacent to rotor assembly 50 preferably includes beveled surface 94 formed thereon. For one application beveled surface 94 is formed at an angle of approximately sixty-five degrees (65°) relative to surface 96. Depending upon the dimensions of rotor assembly 50 and the type of wood or bark being fed into chute 30, the angle of beveled surface 94 formed on each screen bar 92 may be varied from seventy-five degrees (75°) to forty-five degrees (45°) to optimize the quantity of wood chips 49 produced by hammermill 20 which are satisfactory for use in high quality paper manufacturing. Beveled surfaces 94 cooperate with flexible hammers 60 to reduce fines and undersized chips 47 produced by hammermill 20.

Beveled surface 94 cooperates with surface 96 to form cutting edge 118 projecting towards flexible hammers 60. The angle formed by the intersection of beveled surface 94 and surface 96 is selected to provide a relatively sharp cutting edge 118 with sufficient thickness to avoid excessive wear. Thus, the present invention allows varying the angle of beveled surface 94 depending upon characteristics of wood 24, bark 26 and/or oversized wood chips 28 and the desired size for chips 49. For some applications, the angle of beveled surface 94 may be forty-five degrees (45°) or less. For other applications, the angle of beveled surface 94 may be seventy-five degrees (75°) or more.

During rotation of rotor assembly 50, flexible hammers 60 extend radially outward to define a crushing circle or reducing zone. As best shown in FIG. 2, each screen bar 92 is preferably inclined at an acute angle relative to a line extending from the axis of rotation of shaft 56, corresponding approximately with the radius of the crushing circle. This angle is sometimes referred to as the "sweep angle." Depending upon the type of material and desired output, screen bar assembly 90 may have a "positive" sweep angle inclined into the direction of rotation of rotor assembly 50 such as shown in FIG. 2 or a "negative" sweep angle inclined in the same direction as the direction of rotation of rotor assembly 50. Screen bars 92 cooperate with rotor assembly 50 to reduce the size of wood 24, bark 26 and/or oversized wood chips 28 that are fed into chute 30. Variations in sweep angle orientation and spacing between adjacent screen bars 92 are largely responsible for determining the size and configuration of wood chips 49 produced by the associated hammermill 20.

Figure 3:
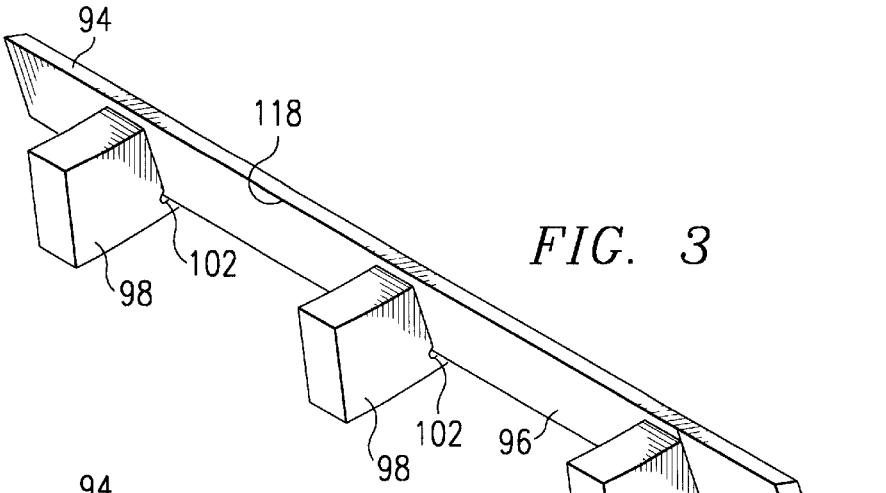
FIG. 3 is a schematic drawing showing an isometric view of a beveled screen bar and mesh blocks incorporating teachings of the present invention satisfactory for use with the hammermill of FIGS. 1 and 2.
Figure 4:
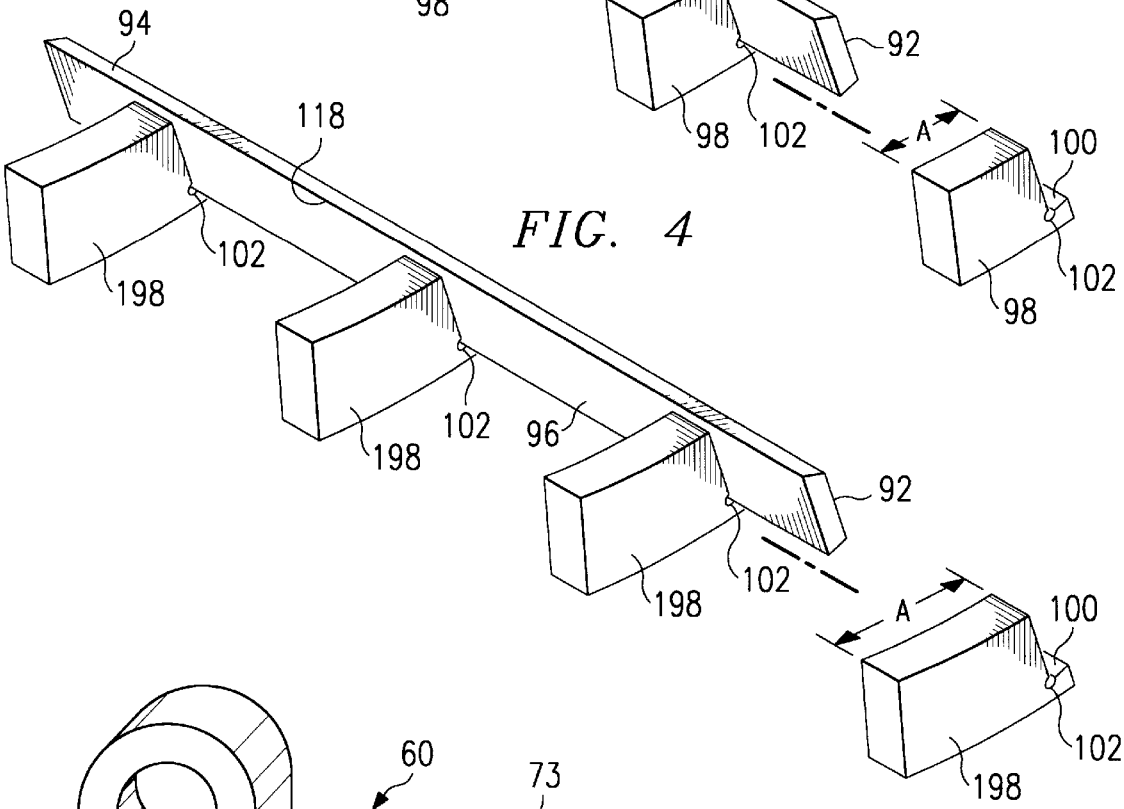
FIG. 4 is a schematic drawing showing an exploded, isometric view of a beveled screen bar and mesh blocks incorporating another embodiment of the present invention satisfactory for use with the hammermill of FIGS. 1 and 2.
Figure 5:
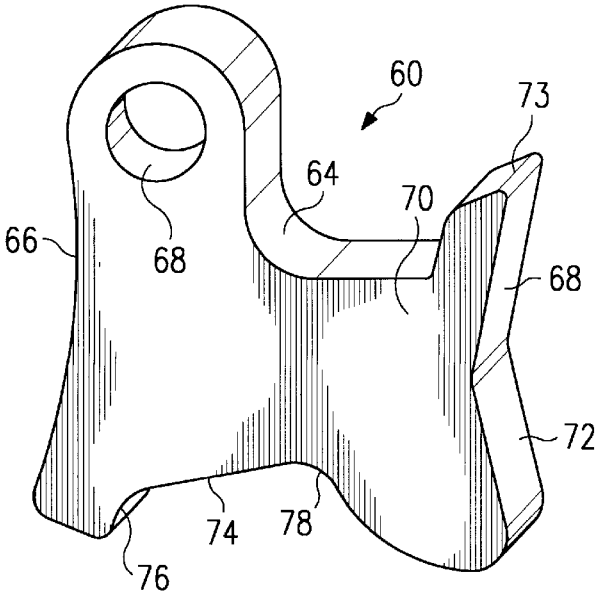
FIG. 5 is a schematic drawing showing an isometric view of a flexible hammer satisfactory for use with the hammermill in FIGS. 1 and 2.

As best shown in FIGS. 3 and 4, each screen bar 92 is preferably disposed on and attached to a plurality of mesh blocks 98 and 198. For one application, approximately nine (9) mesh blocks 98 are used to support each screen bar 92. Mesh blocks 98 and 198 preferably have a radius of curvature corresponding approximately with the radius of curvature associated with rotor assembly 50. For one application, dimension A of screen block 98 is approximately two and one-half (2½) inches. For another application, dimension A of mesh block 198 is approximately three and three-fourths (3¾) inches. Each mesh block 98 and 198 preferably includes cutout or notch 100. Each screen bar 92 may be welded to the selected mesh blocks 98 or 198 adjacent to respective notches 100. Relief groove 102 is preferably formed in each mesh block 98 and 198 to minimize stress from contact with the associated screen bar 92. Mesh blocks 98 and 198 cooperate with their associated screen bars 92 to define in part apertures 104 extending through screen bar assembly 90.

Screen bars having a beveled surface in accordance with teachings of the present invention may be installed within a hammermill using other techniques and is not limited to the use of mesh blocks 98 and 198. Also, a screen bar assembly incorporating teachings of the present invention may be used with a hammermill having fixed hammers or swinging hammers. The present invention is not limited to hammermills with flexible hammers 60. For some applications, a screen bar assembly incorporating teachings of the present invention may be satisfactorily used with a hammermill having fixed hammers which rotate at RPMs less than flexible hammers 60.

Figure 6:
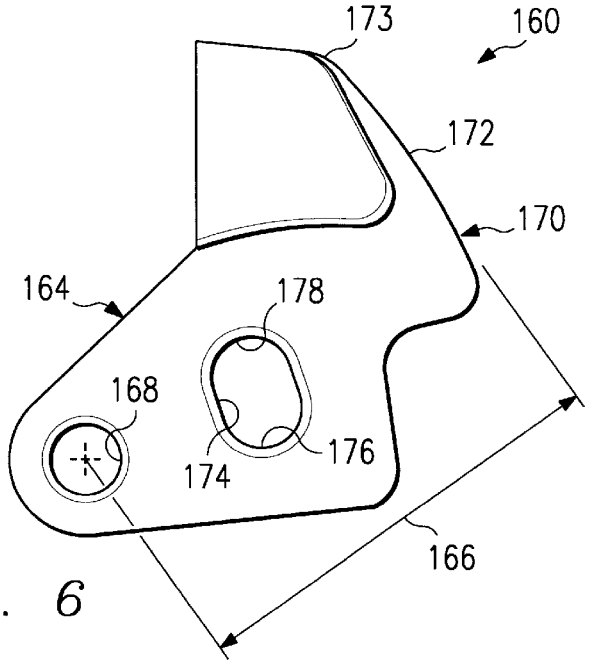
FIG. 6 is a schematic drawing showing an isometric view of a flexible hammer incorporating an alternative embodiment of the present invention.

Flexible hammer 160 incorporating an alternative embodiment of the present invention, is shown in FIG. 6. Flexible hammer 160 includes hammer body 164 having moment arm 166 extending generally from opening 168 to crushing element 170. The dimensions of opening 168 and the outside diameter of support rods 62 are selected to allow one of the support rods 162 to be inserted through opening 168 to rotatably secure a respective flexible arm 160 between adjacent disk rotors 58. Hammer body 164 may be formed from various hard metal alloys and is preferably heat treated for long-term wear.

Flexible hammer 160 includes crushing element 170 formed as an integral part of moment arm 166 opposite from opening 168. Hooked head 172 having at least one carrying surface 173 is preferably formed as an integral part of crushing element 170. The configuration and dimensions of hooked head 172 are selected to be compatible with reducing wood, bark and/or oversized wood chips. For some applications, hooked head 172 and/or crushing element 170 may be formed as separate, replaceable components.

Elongated opening 174 is preferably formed in hammer body 164, intermediate opening 168 and crushing element 170. Elongated opening 174 is sized to receive an adjacent support bar 62. The dimensions of flexible hammer 160 and elongated opening 174 along with the radial spacing between adjacent support rod 62 are selected to allow limited movement of flexible hammer 160 radially inward and radially outward relative to the associated rotor assembly 50. Interior surfaces 176 and 178 of elongated opening 174 will contact the respective support rod 62 to define the limits for radial movement of the associated flexible hammer 160. Moment arm 166 serves as a fulcrum to maintain crushing element 170 and hooked head 172 radially extended when the associated rotor assembly is rotating at relatively low RPMs.

Flexible hammers 60 and 160 are representative of only two embodiments of the present invention. Various types of flexible hammers may be formed in accordance with the teachings of the present invention and satisfactorily used in a slow speed hammermill to reduce oversized wood chips. For one application, a slow speed hammermill having a plurality of flexible hammers 160 significantly increased the recovery rate of resized wood chips from oversized wood chips.

Some of the reduction in the size of wood 24, bark 26 and oversized chips 28 occurs as a result of impact with breaker plates 38. Most of the attrition and size reduction results from flexible hammers 60 and/or 160 forcing oversized chips 28 against screen bar assembly 90. In addition to reducing the size of wood chips 28, flexible hammers 60 and/or 160 in cooperation with screen bar assembly 90 also break or fracture the grain fibers of wood chips 28. Beveled surfaces 94 cooperates with flexible hammers 60 and/or 160 to further reduce the amount of fines produced by hammermill 20. As a result, wood chips 49 exiting from screen bar assembly 90 will have the desired dimensions to produce cellulose fibers of the required length to manufacture high quality paper. Also, wood chips 49 produced by hammermill 20 will be of the appropriate size and many wood chips 49 will have fractured grain fibers to allow improved penetration of the solvent used in the cooking process to digest wood chips 49.

Although the present invention has been described in detail with respect to alternative embodiments, various changes and modifications may be suggested to one skilled in the art, and it should be understood that various changes, substitutions, and alterations can be made without departing from the scope and the spirit of the invention as defined by the following claims.

What is claimed is:

1. A hammermill having a housing with an inlet for receiving wood, bark and oversized wood chips and a rotor assembly disposed within the housing for reducing the size of the wood, bark and oversized chips to wood chips having a desired size comprising:

a screen bar assembly having a plurality of screen bars spaced from each other and secured within the housing adjacent to the rotor assembly;

the rotor assembly having a generally cylindrical configuration with a longitudinal axis of rotation extending through the housing;

the rotor assembly disposed between the inlet of the housing and the screen bar assembly;

the screen bar assembly having a generally semicircular configuration with a radius of curvature compatible with the configuration of the rotor assembly;

the screen bars extending substantially parallel with the longitudinal axis of the rotor assembly;

a plurality of flexible hammers pivotally attached to the rotor assembly to allow limited movement of each flexible hammer radially inward and outward relative to the rotor assembly; and a beveled surface formed on one edge of each screen bar adjacent to the rotor assembly whereby the flexible hammers cooperate with the beveled edges of the screen bars to form the wood chips having the desired size when the rotor assembly is rotating at less than seven hundred revolutions per minute.

2. The hammermill of claim 1 further comprising:

a pair of bearing assemblies mounted on and secured to the housing the rotor assembly including a shaft extending through the housing and rotatably mounted on the bearing assemblies;

a plurality of rotor disks concentrically disposed on and secured to the shaft;

a plurality of support bars extending longitudinally through the rotor disks and spaced approximately an equal distance from each other adjacent to the outside diameter of the rotor disks;

each flexible hammer pivotally secured to a first support bar; and each flexible hammer engaged with a second support bar to support radial movement of the respective flexible hammer relative to the shaft.

3. The hammermill of claim 1 further comprising:

a plurality of mesh blocks attached to each screen bar with the mesh blocks extending between adjacent screen bars to establish a desired spacing between adjacent screen bars selected to determine in part the desired size of wood chips produced by the hammermill;

the screen bars and the mesh blocks cooperating with each other to form in part the screen bar assembly; and the screen bars and the mesh blocks cooperating with each other to form a plurality of apertures extending through the screen bar assembly.

4. The hammermill of claim 1 wherein each flexible hammer further comprises:

a hammer body having a moment arm with an opening formed at one end of the moment arm;

the opening having dimensions selected to allow inserting a first support rod therethrough; and a crushing element formed on the end of the moment arm opposite from the opening.

5. The hammermill of claim 4 wherein each flexible hammer further comprises:

a recess formed in the crushing element opposite from the opening in the moment arm; and a portion of a second support rod disposed within the recess to limit movement of the respective flexible hammer radially inward and radially outward relative to the rotor assembly.

6. A hammermill having a housing with an inlet for receiving wood, bark and oversized wood chips and a rotor assembly disposed within the housing for reducing the size of the wood, bark and oversized chips to wood chips having a desired size comprising:

a screen bar assembly having a plurality of screen bars spaced from each other and secured within the housing adjacent to the rotor assembly;

the rotor assembly having a generally cylindrical configuration with a longitudinal axis of rotation extending through the housing;

the rotor assembly disposed between the inlet of the housing and the screen bar assembly;

the screen bar assembly having a generally semicircular configuration with a radius of curvature compatible with the configuration of the rotor assembly;

the screen bars extending substantially parallel with the longitudinal axis of the rotor assembly;

a plurality of flexible hammers pivotally attached to the rotor assembly to allow limited movement of each flexible hammer radially inward and outward relative to the rotor assembly;

a beveled surface formed on one edge of each screen bar adjacent to the rotor assembly whereby the flexible hammers cooperate with the beveled edges of the screen bars to form the wood chips having the desired size; and each flexible hammer including a hook head having at least one tearing edge formed on a respective crushing element to impact the wood, bark and oversized wood chips.

7. The hammermill of claim 1, further comprising:

each screen bar having a longitudinal edge with a length corresponding approximately with the length of the rotor assembly disposed within the housing; and the beveled surface formed along the longitudinal edge of each cross bar adjacent to the rotor assembly.

8. The hammermill of claim 1, wherein each screen bar has a beveled surface formed at an angle between 75° and 45°.

9. The hammermill of claim 1, wherein the screen bar assembly further comprises the screen bars oriented having a positive sweep angle relative to the longitudinal axis of the rotor assembly to reduce the amount of fines and small undersized wood chips produced by the hammermill.

10. The hammermill of claim 9, wherein the positive sweep angle is in the range of 10° to 20° to reduce the amount of fines and small undersized wood chips produced by the hammermill.

11. A hammermill for reducing oversized wood chips comprising:

a housing having an inlet to receive the oversized wood chips;

a rotor assembly disposed in the housing having a plurality of flexible hammers pivotally secured therewith to contact the oversized wood chips introduced through the inlet;

the rotor assembly having a generally cylindrical configuration with a longitudinal axis corresponding to the axis of rotation of the rotor assembly;

each flexible hammer having a radially extended position which generally describes a circle as the rotor assembly revolves;

a screen bar assembly disposed below the rotor assembly adjacent to the circle;

the screen bar assembly having a plurality of screen bars radially spaced from each other and secured within the housing;

a pair of bearing assemblies mounted on and secured to the housing the rotor assembly including a shaft extending through the housing and rotatably mounted on the bearing assemblies;

a plurality of rotor disks concentrically disposed on and secured to the shaft;

a plurality of support bars extending longitudinally through the rotor disks adjacent to the outside diameter of the rotor disk;

the flexible hammers cooperating with the support bars to allow limited radial movement of each flexible hammer between its radially extended position and a radially retracted position relative to the shaft of the rotor assembly as the flexible hammers contact oversized wood chips;

each screen bar having a longitudinal edge disposed adjacent to the rotor assembly; and a beveled surface formed on the longitudinal edge of each screen bar adjacent to the rotor assembly.

12. The hammermill of claim 11 further comprising each beveled surface formed at an angle of approximately 65°.

13. A hammermill for reducing oversized wood chips comprising:

a housing having an inlet to receive the oversized wood chips;

a rotor assembly disposed in the housing having a plurality of flexible hammers pivotally secured therewith to contact the oversized wood chips introduced through the inlet;

the rotor assembly having a generally cylindrical configuration with a longitudinal axis corresponding to the axis of rotation of the rotor assembly;

each flexible hammer having a radially extended position which generally describes a circle as the rotor assembly revolves;

a screen bar assembly disposed below the rotor assembly adjacent to the circle;

the screen bar assembly having a plurality of screen bars radially spaced from each other and secured within the housing;

a pair of bearing assemblies mounted on and secured to the housing the rotor assembly including a shaft extending through the housing and rotatably mounted on the bearing assemblies;

a plurality of rotor disks concentrically disposed on and secured to the shaft;

a plurality of support bars extending longitudinally through the rotor disks adjacent to the outside diameter of the rotor disk;

the flexible hammers cooperating with the support bars to allow limited radial movement of each flexible hammer between its radially extended position and a radially retracted position relative to the shaft of the rotor assembly as the flexible hammers contact oversized wood chips;

each flexible hammer including a hammer body having a moment arm with a first opening formed at one end of the moment arm;

the first opening having dimensions selected to allow inserting a first support rod therethrough;

a crushing element formed on the hammer body opposite from the first opening;

a second opening having a generally elongated configuration formed in the hammer body intermediate the first opening and the crushing element;

the moment arm extending generally from the first opening through the second opening to an exterior portion of the crushing element; and a second support rod disposed within the second opening to allow only limited movement of the respective flexible hammer radially inward and radially outward during rotation of the rotor assembly.

* * * * *